US006510873B2

(12) United States Patent
Nagura

(10) Patent No.: US 6,510,873 B2
(45) Date of Patent: Jan. 28, 2003

(54) PRESS FABRIC WITH BUNDLED YARN FOR PULP MACHINE

(75) Inventor: Hiroyuki Nagura, Shizuoka (JP)

(73) Assignee: Nippon Filcon Co. Ltd., Tokyo (JP)

( * ) Notice: Subject to any disclaimer, the term of this patent is extended or adjusted under 35 U.S.C. 154(b) by 11 days.

(21) Appl. No.: 09/960,988

(22) Filed: Sep. 25, 2001

(65) Prior Publication Data

US 2002/0056483 A1 May 16, 2002

(30) Foreign Application Priority Data

Sep. 26, 2000 (JP) ..... 2000-331459

(51) Int. Cl.[7] ..... D03D 15/00
(52) U.S. Cl. ..... 139/383 A; 139/426 R
(58) Field of Search ..... 139/383 A, 426 R

(56) References Cited

U.S. PATENT DOCUMENTS 4,105,495 A * 8/1978 Pai ..... 139/383 A
4,202,382 A * 5/1980 Westhead ..... 139/383 A

FOREIGN PATENT DOCUMENTS

JP 61070044 A * 4/1986
JP 410053993 A * 2/1998

* cited by examiner

*Primary Examiner*—Danny Worrell
*Assistant Examiner*—Robert Muromoto
(74) *Attorney, Agent, or Firm*—Rader, Fishman & Grauer PLLC

(57) ABSTRACT

A press fabric for a pulp machine is a weft-abrading type fabric manufactured by weaving a warp monofilament and a bundled yarn. The bundled yarn has fine water-sucking spaces formed between raw filaments of a small diameter by bundling up the raw filaments. Monofilaments may also be used as the wefts in combination with the bundled yarns. The bundled yarn forms the most protuberant crimp to the surface of the fabric which results in improved water-sucking ability, washing ability, showering resistance, and abrasion resistance.

10 Claims, 3 Drawing Sheets

PRESS FABRIC WITH BUNDLED YARN FOR PULP MACHINE

TECHNICAL FIELD OF THE INVENTION

The present invention relates to a press fabric for a pulp machine which is used at pressing parts of the pulp machine and has excellent water-sucking ability, washing ability, showering resistance, and abrasion resistance, particularly a press fabric for the pulp machine suitable for a double wire machine such as heavy-duty press, and, of course, usable in a double wire press forming a pulp sheet having both functions of dewatering and pressing.

BACKGROUND OF THE INVENTION

Pulp manufacturing method is a well-known technology, wherein a raw material containing pulp fibers etc. is generally conveyed from a head box and fed to an endless fabric for making pulp which runs with being suspended between the rolls of a pulp sheet-manufacturing apparatus. The raw material fed is transferred together with the running of the fabric and moisture is removed by a dehydrating apparatus or the like to form a pulp sheet during the transfer. The pulp sheet formed is then transferred to a press part and, if necessary, to a dryer part. At the press part, the pulp sheet is transferred by a felt for pressing. Moisture is further discharged by passing through a series of press nip constituted by the combination of the felt and press rolls. Alternatively, in a heavy duty press or double wire press, a method of placing a pulp sheet to be a raw material of paper between two felts and sucking water by nip pressure is used. At the dryer part, the pulp sheet is transferred by a canvas and the pulp sheet is finally manufactured by drying.

The water-sucking medium hitherto used at the press part includes felts and woven fabrics. Specifically, examples include a needle felt wherein a batt of a synthetic fiber is crossed by needling on the front and back surface of a base cloth woven with a monofilament or a multifilament, a fabric obtained by weaving by a loom using the warp and weft of a monofilament and making endless by tying up through weaving, and a fabric woven by a hollow weave machine using a multifilament as the upper weft and lower weft and a monofilament as the warp. The fabric woven by a hollow weave loom is formed as an endless one at the stage of weaving by the loom. Since the fabric has a characteristic that the relation between the warp and weft is reversed on the loom and at use, the above fabric woven as hollow weave becomes a fabric of double warp and single weft weave at use.

SUMMARY OF THE INVENTION

Since the needle felt has a structure filled with fine batt of synthetic fiber from the front surface to back surface, it is a water-sucking medium having a low water-flow resistance and a good water-sucking ability. When it absorbs water from a pulp sheet, fine fibers, chemicals, etc. simultaneously enter into the felt, and their removal requires vigorous washing. However, the contaminants are difficult to remove owing to the structure filled with fine batt of synthetic fiber, so that the remaining contaminants causes dewatering blotches and the use of high pressure washing shower for washing the contaminants etc. sometimes results in the occurrence of hole formation through the cleavage of the batt fiber by the impact of shower pressure. In addition, since the felt has a bad cushioning property and nipping resistance, there is a problem that the batt is broken and gradually compressed to reduce the thickness during the use, and in proportion thereto, the water-sucking ability decreases.

Moreover, there is a defect that the felt has a bad elongation rigidity, flexure rigidity, stability of size and position. For good running of the felt on which a pulp sheet is loaded, it is necessary to transfer the power of driving rolls surely to the felt in the state that tension is applied. However, the needle felt has a weak elongation rigidity and also exhibits a large shrinkage of width and a large decrease of thickness which occur in proportion to the elongation, so that it is impossible to apply a large tension and thus a good running cannot be effected.

Also, there is a problem of a slip. The occurrence of a slip has resulted problems that the abrasion of the running surface of the felt is accelerated and electrical load is increased to stop the machine, and has sometimes exerted a serious influence on the productivity. In addition, since the felt is weak in flexure rigidity, it cannot resist the weight of a raw material and deflection has sometimes occurred to result in the breaking or crack of the pulp sheet.

Furthermore, with the needle felt, there is a problem that manufacturing cost is high because it takes a lot of trouble and time to carrying out needling, heating after the needling, compaction of the felt by mechanical compaction, and the like. Although the needle felt is a water-sucking medium excellent in water-sucking ability, but has several serious problems in washing ability, rigidity, dimensional stability, etc.

Therefore, other than the needle felt, a single fabric or a double-warp fabric has been employed regarding washing ability and rigidity as important. The single fabric is manufactured by weaving a monofilament having a high high-pressure washing-shower resistance used as the warp and weft, and was made endless by a well-known method of tying up through weaving. However, these fabrics has a bad water-sucking ability owing to the absence of fine fiber spaces effective for water-sucking and also lacks flexibility and cushioning property, so that there arises a problem that a pulp sheet is broken under a high nip pressure, and thus it is extremely difficult to impart the properties required in the press step.

Moreover, the fabric woven and formed as an endless one at the stage of weaving with a hollow weave loom has hitherto been used because of the advantage of saving the trouble of tying up through weaving. In the case of hollow weave, since the relation between the warp and the weft is reversed on the loom and at use, the fabric manufactured by weaving a multifilament weft arranged doubly and a single monofilament warp arranged singly became a fabric of double multifilament warp and single monofilament weft having a structure that the weft is protruded to the running surface side.

The most protuberant monofilament weft to the running surface side is gradually crushed with a high nip pressure by pressing, and as the protrusion of the monofilament weft becomes small, the multifilament of the warp comes into contact with the press rolls. After the fabric reaches this state, the moisture contained in the fabric begins to move effectively to the press rolls and a sufficient water-sucking is effected. Precisely, an excess moisture from the pulp sheet moves to the fabric from the pulp sheet with nip pressure by pressing, passes through fine water-sucking spaces of the multifilament constituting the fabric, and a series of dewatering is completed by bringing the multifilament containing moisture into contact with the rolls. In the case of a structure that a monofilament is the most protuberant and thus a multifilament do not sufficiently come into contact with the press rolls, there are problems that water-sucking ability is bad until the multifilament of the warp is brought into contact with the press rolls, and moreover, the protruded monofilament is severely abraded by friction with the rolls.

As described above, a needle felt or a conventional press fabric manufactured by weaving a monofilament and a multifilament cannot serve excellent effects in water-sucking ability, washing ability, showering resistance, and abrasion resistance.

In view of the problems of the conventional technology, the present invention is to provide a press fabric for a pulp machine excellent in water-sucking ability, washing ability, showering property, and abrasion resistance.

A press fabric for a pulp machine of this invention is a weft-abrading type fabric obtained by weaving a monofilament used as a warp and a bundled yarn as a weft. The bundled weft yarn has fine water-sucking spaces formed by bundling up raw filaments of a small diameter and forms the most protuberant crimp on the surface of the fabric. The most protuberant crimp may particularly be formed on the running side surface of the fabric.

Also, a press fabric for a pulp machine of this invention is a weft-abrading type fabric obtained by weaving in a multi-layer state a monofilament used as a warp and a bundled yarn as a weft. The bundled yarn forms the most protuberant crimp on a surface of the fabric.

More detailed embodiments of this invention will be described below.

PREFERRED EMBODIMENTS OF THE INVENTION

Figure 1:
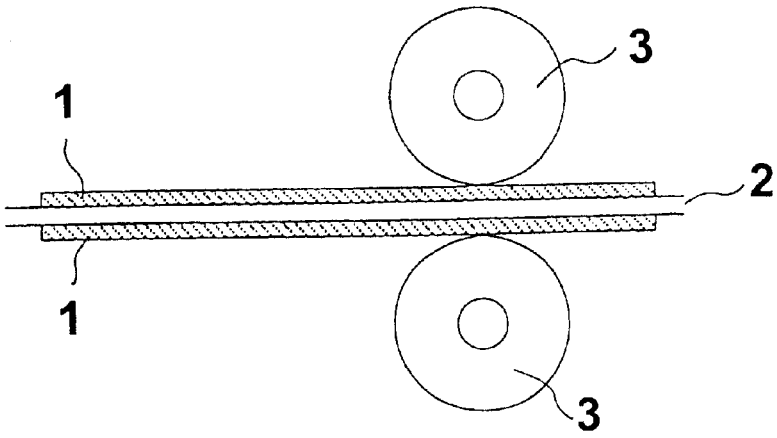
FIG. 1 is a part of an apparatus layout of the press part wherein a press fabric for pulp is used.

A press fabric for a pulp machine of the present invention is used for sucking water by placing a pulp sheet containing much moisture, i.e., a raw material for paper, on the fabric or placing the pulp sheet on and under the press fabrics, and passing the sheet under pressing with press rolls.

An excess moisture sucked from the pulp sheet with nip pressure by pressing moves to the press fabric, and the yarn having fine water-sucking spaces present from the front and back surfaces of the press fabric is functioned as continuous conduits to converge the moisture on the running surface side of the press fabric by capillary phenomenon and the like, and finally the moisture converged on the running surface side is efficiently sucked by bringing the yarn having fine water-sucking spaces into contact with the rolls.

The press fabric of the present invention has a structure capable of effecting the dewatering of the pulp sheet sufficiently, and is characterized by being woven to be a weft-abrading type by cross-weaving a monofilament as a warp and a yarn having fine water-sucking spaces formed between raw filaments of a small diameter by bundling up the raw filaments (hereinafter referred to as a "bundled yarn") as a weft, wherein the bundled yarn forms the most protuberant crimp on the surface of the fabric. The structure that the yarn forming fine water-sucking spaces are protruded to the pulp sheet surface side facilitates the movement of excess moisture from the pulp sheet. In addition, a specific formation of similar protrusion on the running surface can bring excellent effects on water-sucking ability and abrasion resistance.

Since this press fabric has a structure that the weft having fine water-sucking spaces formed at the running surface side is protruded the most, the weft having fine water-sucking spaces comes into contact with the press rolls from the beginning of the use and thus, an excess moisture moved from the pulp sheet to the press fabric easily transferred to the rolls. Moreover, since the press fabric of the present invention is manufactured by weaving not only the yarn forming fine water-sucking spaces but also a monofilament, the fabric is excellent in rigidity and washing ability, and is resistant to washing under high pressure. Furthermore, owing to the weft-abrading type fabric, there is no remarkable abrasion of the warp responsible to elongation rigidity, the fabric has nip resistance, and crush of the weft having fine water-sucking spaces formed between raw filaments by bundling up protruded raw filaments can be prevented.

The press fabric manufactured by weaving the bundled yarn used as the weft is an aggregate of fine fibers similar to the batt of a needle felt, but, since the whole has a woven net structure, the weft is woven in the warp and the warp in the weft each other in a short cycle and they are strongly tied up, so that the fabric is excellent in rigidity, and owing to the small decrease of the thickness, the water-sucking spaces are not crushed and also the yarns are not cleaved or dropped out by the impact of showering water. The press fabric of the present invention has not a structure that fine fibers are densely packed in the direction of Z-axis like a needle felt, but are a fabric structure that fine fibers are strongly tied up, so that the fabric has openings and thus contaminants are hardly accumulated. In addition, the bundled yarn exhibits a satisfactory showering resistance and therefore, the fabric can be resistant to shower under high pressure.

Furthermore, by arranging the bundled yarn at least part of each layer of the press fabric of the present invention wherein the weft is arranged multilayer-wise, water-sucking ability, cushioning property, and rigidity are further improved. With regard to the water-sucking ability, since fine water-sucking spaces are present in each layer, continuous conduits for passing moisture are formed from the pulp surface side to the running surface side, an excess moisture from the pulp sheet is converged on the running surface side of the press fabric by capillary phenomenon and the like, and finally the moisture is efficiently sucked by bringing the yarn having the fine water-sucking spaces containing moisture into contact with the rolls.

Moreover, with regard to the mixing ratio of the bundled yarn and a monofilament, there is a tendency that water-sucking ability is enhanced by using the yarn having fine water-sucking spaces formed between the raw filaments of the small diameter by bundling up the raw filaments much more, and rigidity is improved by arranging the monofilament much more. In particular, when the yarn having fine water-sucking spaces formed between the raw filaments of the small diameter by bundling up the raw filaments is arranged much more at the running surface side, the contact area between the yarn having fine water-sucking spaces containing much moisture and the rolls increases, so that the fabric becomes excellent in water-sucking ability. Since water-sucking ability is required for the press fabric, the yarn having fine water-sucking spaces formed between the raw filaments of the small diameter by bundling up the raw filaments is used usually much more than the monofilament, and the mixing ratio thereof is from 1:1 to 3:1.

When the weft at the running surface side is woven so as to form a structure wherein the weft forms a long crimp corresponding to at least two yarns of the warp on the running surface, the yarn protruding to the running surface side and having fine water-sucking spaces formed between the raw filaments of the small diameter by bundling up the raw filaments containing much moisture forms a large contact surface with the rolls and thus the movement of moisture to the rolls sufficiently occurs and water-sucking ability is satisfactory. In addition, the long crimp of the weft makes the fabric more excellent in abrasion resistance than conventional fabrics.

For efficient water-sucking, it is important to make the pressure gradient of the fluid high, which passes through the pulp sheet and press fabric under nip pressure, that is, to make the power of water flow from the pulp sheet to the press fabric large. Moreover, it is apparent that the smaller resistance of passing water facilitates water-sucking, and a proper denseness of the surface can reduce the re-absorption of moisture by the pulp sheet at the exit side of press nip. Furthermore, water-sucking ability and cushioning property are closely related and the yarn having fine water-sucking spaces formed between the raw filaments of the small diameter by bundling up the raw filaments has an appropriate cushioning property, so that water-sucking ability is exhibited at the restore of compaction. In addition, press nip action can be absorbed by an appropriate compressive elasticity, whereby breakage and the like of the pulp sheet can be reduced.

Examples of the yarn having fine water-sucking spaces formed between the raw filaments of the small diameter by bundling up the raw filaments used herein include a spun yarn, multifilament, a raising yarn, a monofilament twisted yarn, a mole yarn, a filament-processed yarn, a yarn obtained by winding a spun yarn to a core thread of monofilament, a yarn obtained by winding multifilament to a core thread of monofilament, or a yarn obtained by twisting two or more of these yarns in combination.

By the way, in the present specification, the spun yarn means a yarn formed by gathering and bundling short fibers, and includes a yarn manufactured by spinning, or the like. The multifilament means a yarn formed by gathering and bundling fine short fibers, and the raising yarn means a yarn formed by scratching the surface of the multifilament with a needle like material to cause nap. The filament-processed yarn means a yarn formed by subjecting a filament yarn to expansion and contraction processing, sublime processing, crimp processing, or the like, and includes yarns generally called as a textured yarn, a bulky yarn, stretcher yarn, and a Taslan processed yarn, as well as a wooly nylon and the like. The mole yarn is a yarn formed by arranging short fibers radially using a core yarn such as multifilament as an inner core. The yarn wherein the short fibers arranged radially is subjected to crimp processing or the like is also included.

With regard to the yarns for manufacturing the press fabric by weaving, at least one yarn selected from a monofilament, a monofilament-twisted yarn, and a yarn whose core is a monofilament may be used as the warp. The warp of the monofilament or the like used herein also plays a role of enhancing rigidity and dimensional stability. The weft is made by cross-weaving a monofilament or the like with the bundled yarn. This is because the use of the monofilament enhances rigidity and the like. However, the bundled yarn is important for enhancing water-sucking ability. In a multilayer fabric, because conduits for passing water are formed with fine water-sucking spaces continuous from the pulp surface side to the running surface side, the fabric has desirably a structure wherein the bundled yarn is used at least part of each layer. That is, in the case of triple weft weave, the bundled yarn is used at least part of each layer of the pulp surface side layer, the running surface side layer, and an intermediate layer.

Furthermore, the press fabric may have a weft-abrading structure wherein the bundled yarn forms protuberant crimps on the surface of the fabric, and also may have a structure wherein the bundled yarn is arranged to at least part of each layer. It is possible to adopt various structures such as double layer structures of a single warp-double weft type, a single warp-triple weft type, a double warp-triple weft type, and a double warp-double weft type. In particular, a structure wherein the yarn having fine water-sucking spaces formed is protruded to the running surface side brings excellent effects on water-sucking ability and abrasion resistance.

The material of the yarn is not particularly limited and various materials such as synthetic fibers including polyesters, polyamides, polyphenylene sulfide, etc., chemical fibers including rayon etc., and natural fibers including cotton etc. can be used. When a polyamide is used as the weft at the running surface side, nip resistance to pressing, and fibrilation property become satisfactory, while the use of polyester increases rigidity. Therefore, it is preferable to select the material of the yarn depending on the application.

EXAMPLES

The mode for carrying out the invention will be explained based on Examples with reference to Drawings. FIG. 1 is part of an apparatus layout drawing of the press part wherein a press fabric for pulp is used. It is an apparatus for sucking an excess moisture by placing a press fabric 1 between the rolls, conveying a pulp sheet 2 with placing the sheet between the two press fabrics, and pressing them with two combined press rolls 3.

EXAMPLE 1

Figure 2:
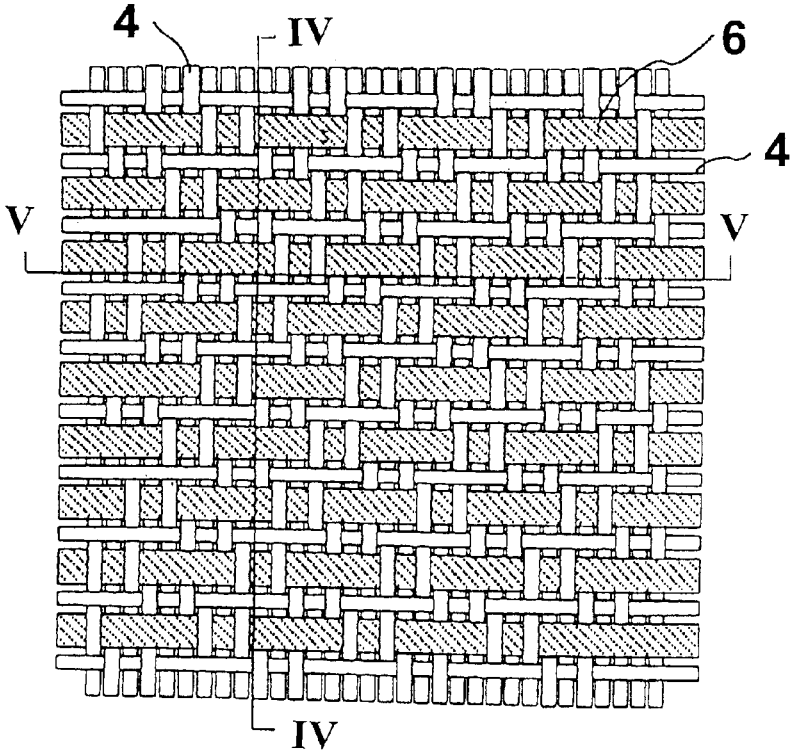
FIG. 2 is a top view of the pulp surface side illustrating an example of the press fabric of the present invention.
Figure 3:
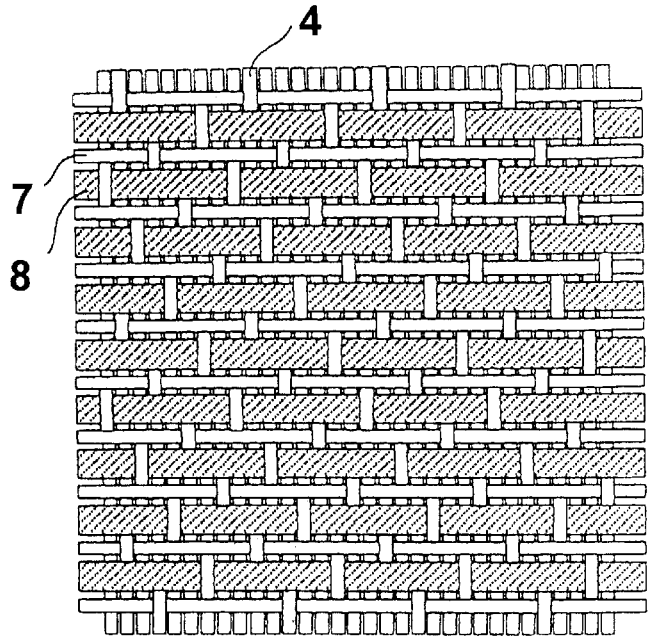
FIG. 3 is a top view of the running surface side illustrating an example of the press fabric of the present invention.
Figure 4:
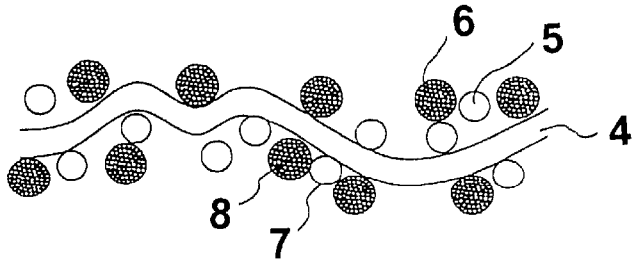
FIG. 4 is a cross-sectional view of the warp cut along the line VI—VI in FIG. 2.
Figure 5:
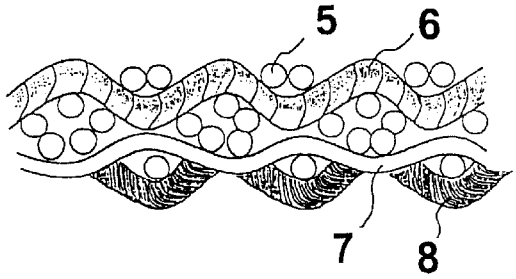
FIG. 5 is a cross-sectional view of the weft cut along the line V—V in FIG. 2.

FIGS. 2 to 5 show examples of a press fabric for a pulp machine of the present invention. FIG. 2 is a top view of the pulp surface side, and FIG. 3 is a top view of the running surface side. FIG. 4 is a sectional view along the warp, cut along the line IV—IV in FIG. 2. FIG. 5 is a sectional view along the weft, cut along the line V—V in FIG. 2. This is the press fabric for the pulp machine of single warp-double weft weave of eight shafts wherein a polyamide monofilament having a diameter of 0.60 mm is arranged in a number of 48 per inch as the warp, a polyamide monofilament 5 having a diameter of 0.60 mm and a polyamide multifilament crimp processed yarn 6 formed by twisting 3 yarns of 55 filaments of 23 denier crimp fine filament are arranged one after the other in a number of 20 per inch as the pulp surface side weft, a polyamide monofilament 7 and a polyamide multifilament crimp processed yarn 8 formed by twisting 3 yarns of 55 filaments of 23 denier crimp fine filaments are arranged one after the other in a number of 20 per inch as the running surface side weft. The polyamide multifilament crimp processed yarns 6 and 8 of Example 1 are weft bundled yarn having fine water-sucking spaces formed by bundling up raw filaments.

Moreover, with reference to the sectional views shown in FIGS. 4 and 5, it is clear that the bundled yarn is more protuberant to the surface than the monofilaments used as other warp or weft.

EXAMPLE 2

The following shows other example of a press fabric for a pulp machine. This is the press fabric for the pulp machine of single warp-triple weft weave of eight shafts wherein a polyamide monofilament having a diameter of 0.60 mm is arranged in a number of 48 per inch as the warp, a polyamide monofilament having a diameter of 0.60 mm and a polyamide multifilament crimp processed yarn formed by twisting 3 yarns of 55 filaments of 23 denier crimp fine filaments are arranged one after the other in a number of 18 per inch as the pulp surface side weft, a composite yarn formed by twisting 4 filaments of 540 denier taslan processed filament and 55 filaments of 23 denier crimp fine filament as the weft of the intermediate layer, and a polyamide monofilament and a polyamide multifilament crimp processed yarn formed by twisting 3 yarns of 55 filaments of 23 denier crimp fine filament are arranged one after the other in a number of 18 per inch as the running surface side weft. The polyamide multifilament crimp processed yarn and the composite yarn of Example 2 are weft bundled yarn having fine water-sucking spaces formed by bundling up raw filaments.

EXAMPLE 3

The following shows other example of a press fabric for a pulp machine. This is the press fabric for the pulp machine of single warp-double weft weave of eight shafts wherein a polyamide monofilament having a diameter of 0.60 mm is arranged in a number of 48 per inch as the warp, a polyamide multifilament crimp processed yarn formed by twisting 3 yarns of 55 filaments of 23 denier crimp fine filament and a polyamide monofilament having a diameter of 0.60 mm are arranged one after the other in a number of 20 per inch as the pulp surface side weft, a polyamide monofilament, a mole yarn having a diameter of 1.5 mm formed by twisting with arranging 26 denier crimp fine filament radially using two multifilaments as the core, and a polyamide multifilament crimp processed yarn formed by twisting 3 yarns of 55 filaments of 23 denier crimp fine filament are arranged one after the other in a number of 20 per inch as the running surface side weft. The polyamide multifilament crimp processed yarn and the mole yarn of Example 3 are weft bundled yarn having fine water-sucking spaces formed by bundling up raw filaments.

The polyamide multifilament crimp processed yarn formed by twisting several crimp fine filaments used in this example means a yarn subjected to sublime processing through waving the yarn. The mole yarn means a yarn wherein two or three polyamide or polyester yarns are used as the core, and fine short fibers are arranged radially among them. Since a lot of fine water-sucking spaces are formed by fine short fibers arranged radially, the yarn is a suitable yarn for press fabric which effects water-sucking by pressing.

As described above, since the bundled yarn is continuously present from the pulp contact surface side of the press fabric, through inside of the press fabric, and finally to the running surface side, the fine water-sucking spaces act as conduits, so that an excess moisture discharged from the pulp sheet by capillary phenomenon is gathered to the running surface side of the fabric. Then, water-sucking can be efficiently effected by the contact of the most protuberant crimp of the bundled yarn at the running surface side with the rolls. Moreover, the yarn having fine water-sucking spaces formed between raw filaments by bundling up the raw filaments enhances cushioning property and nip resistance and each performance is efficiently enhanced by sharing each main role to each weft line. Furthermore, excellent rigidity and washing ability of the fabric can be effected by forming woven net structure.

Comparative Example

The following will show precise structures of conventional press fabrics and needle felt and also Comparative test between a press fabric for a pulp machine which is an example of the present invention and a conventional press fabric and needle felt, whereby the effects of the present invention will be explained.

Comparative Example 1

A single warp-double weft weave of 4 shafts wherein a polyamide monofilament having a diameter of 0.60 mm is arranged in a number of 48 per inch as the warp, and a polyamide monofilament having a diameter of 0.60 mm is arranged in a number of 16 per inch as the weft of both the pulp surface side and the running surface side.

Comparative Example 2

A double warp-single weft weave of 8 shafts wherein a polyamide yarn formed by twisting 3 yarns of 4 filaments of a polyamide monofilament having a diameter of 0.20 mm is arranged in a number of 18 per inch as the pulp surface side warp and a polyamide yarn formed by twisting 3 yarns of 4 filaments of a polyamide monofilament having a diameter of 0.20 mm is arranged in a number of 18 per inch as the running surface side warp, and a polyamide monofilament having a diameter of 0.55 mm is arranged in a number of 44 per inch as the weft. The polyamide yarn formed by twisting 3 yarns of 4 filaments of a polyamide monofilament of Comparative Example 2 is weft bundled yarn having fine water-sucking spaces formed by bundling up raw filaments.

Comparative Example 3

A needle felt wherein a batt made of a polyamide is cross-woven in an amount of 2.2 kg per $m^2$ by needling to a base cloth manufactured by weaving a twisted polyamide monofilament yarn used as the warp and weft. The twisted polyamide yarn is bundled yarn having fine water-sucking spaces formed by bundling up raw filaments.

Figure 6:
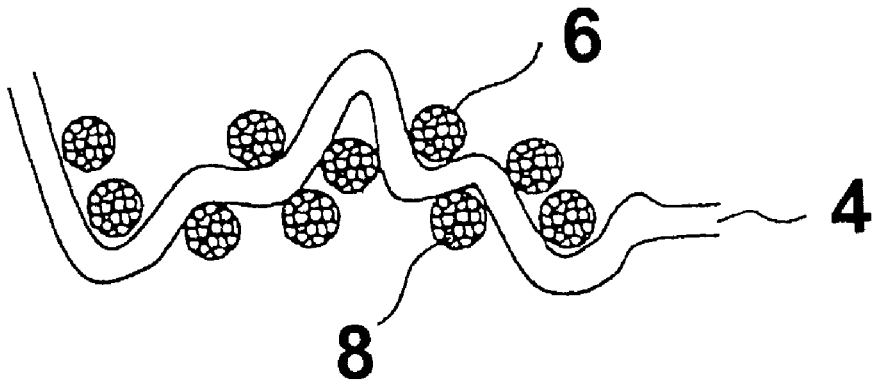
FIG. 6 is a sectional view of the weft of a conventional press fabric for a pulp machine.

The press fabrics of Comparative Examples 1 and 2 were excellent in washing ability and rigidity. But the press fabric of Comparative Example 1 lacked flexibility and cushioning property, and thus, there sometimes arose a problem that a pulp sheet was broken under a high nip pressure. In addition, as shown in FIG. 6, since the press fabric of Comparative Example 2 had a structure wherein the monofilament weft was protruded, there were also problems that water-sucking ability is bad until the multifilament of the warp came into contact with the press rolls and the protruded monofilament was abraded. The needle felt of Comparative Example 3 exhibited a good water-sucking ability but lacked showering resistance, washing ability, cushioning property, nip resistance, and the like, so that there arose problems that the felt was crushed during the use and gradually compacted to reduce the thickness, and in proportion to the reduction, water-sucking ability was decreased.

1. Press Water-Sucking Test

As preliminary pressing, the fabrics of Examples and Comparative Examples and the felt were pressed 100 times at a press roll line pressure of 100 kN/m. Then, two sheets of a pulp sheet (LBKP 550 g/m$^2$) dipped in water for 24 hours were placed between each two sheets of the fabric and the whole was pressed one time for water-sucking at a line pressure of 100 kN/m. The water content of each pressed sheet after the water-sucking was measured and the state of each water-sucking was observed for Examples and Comparative Examples.

1) Water Content

| | |
|---|---|
| Example 1 | 50.9% |
| Example 2 | 50.5% |
| Example 3 | 47.8% |
| Comparative Example 1 | 61.4% |
| Comparative Example 2 | 56.0% |
| Comparative Example 3 | 52.2% |

2. Showering Resistance

Examples and Comparative Examples were placed onto a flame and durability against showering was observed by subjecting them to high pressure showering under the following conditions.

| | |
|---|---|
| Showering pressure: | 2.5 MPa |
| Nozzle diameter: | 1 mm |
| Distance: | 100 mm |
| Sliding distance: | longitudinal direction: 50 mm, lateral direction 50 mm |
| Sliding speed: | longitudinal direction: 50 mm/30 sec, lateral direction 50 mm/7 sec |
| Showering time: | 30 minutes |

In the felt of Comparative Example 3, partial elimination of the fibers, formation of holes and the like were observed, but no damages such as formation of holes and cleavage of yarns were observed in Examples 1 to 3 and Comparative Examples 1 and 2.

From the results of the above comparative tests, it is apparent that water-sucking ability and showering resistance of the press fabrics of the present invention are superior to the conventional press fabrics and needle felt. Since the press fabric of the present invention has aggregate of fine fibers like the batt of the needle felt, the fabric is excellent in water-sucking ability, and since the whole is made of woven net structure, the warp and weft are tied each other, so that the water-sucking spaces are not crushed and the yarns are not cleaved or eliminated by the impact of showering water.

The press fabric of the present invention uses a bundled yarn as the weft and has a structure wherein the yarn forms the most protuberant crimp to the running surface, so that an excess moisture from the pulp sheet is converged on the running surface side of the press fabric by capillary phenomenon and the like. Moreover, the fabric has a structure wherein the yarn containing moisture and having the fine water-sucking spaces formed between the raw filaments of the small diameter by bundling up the raw filaments effectively comes into contact with the rolls, and therefore, water-sucking of the pulp sheet can be sufficiently effected. Thus, the fabric brings excellent effects on water-sucking ability, washing ability, showering resistance and abrasion resistance.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A weft-abrading type press fabric for a pulp machine comprising a warp monofilament and a weft bundled yarn having fine water-sucking spaces formed by bundling up raw filaments, wherein the bundled yarn forms the most protuberant crimp on a surface of the fabric, said fabric further comprises a weft monofilament, wherein a ratio of the weft bundled yarn to the weft monofilament is in a range of 1:1 to 3:1.

2. The press fabric for the pulp machine according to claim 1, wherein the bundled yarn forms the most protuberant crimp on a running surface of the fabric.

3. A weft-abrading type press fabric for a pulp machine comprising, in a multi-layer state, a warp monofilament and a weft bundled yarn having fine water-sucking spaces formed between raw filaments by bundling up the raw filaments, wherein the bundled yarn forms the most protuberant crimp on a surface of the fabric.

4. The press fabric for the pulp machine according to claim 3, wherein the bundled yarn forms the most protuberant crimp on the running surface of the fabric.

5. The press fabric for the pulp machine according to claim 3, wherein the bundled yarn arranged in the multi-layer state forms a more protuberant crimp on a running surface of the fabric than on a pulp contact surface of the fabric.

6. The press fabric for the pulp machine according to claim 3, wherein the fabric further comprises a monofilament as a weft, and a ratio of the bundled yarns arranged in the multi-layer state to the monofilaments is in a range of 1:1 to 3:1, and the bundled yarn is arranged in a larger amount on a running surface of the fabric than on a pulp contact surface.

7. The press fabric for the pulp machine according to claim 1, wherein the weft forms a long crimp corresponding to at least two warps on the running surface.

8. The press fabric for the pulp machine according to claim 3, wherein the weft forms a long crimp corresponding to at least two warps on the running surface.

9. The press fabric for the pulp machine according to claim 1, wherein the bundled yarn being selected from a group consisting of a spun yarn, a multifilament, a raising yarn, a monofilament twisted yarn, a mole yarn, a filament-processed yarn, a yarn obtained by winding a spun yarn on a core of monofilament, a yarn obtained by winding multifilament on a core of monofilament, and a yarn obtained by twisting two or more of these yarns together.

10. The press fabric for the pulp machine according to claim 3, wherein the bundled yarn being selected from a group consisting of a spun yarn, a multifilament, a raising yarn, a monofilament twisted yarn, a mole yarn, a filament-processed yarn, a yarn obtained by winding a spun yarn on a core of monofilament, a yarn obtained by winding multifilament on a core of monofilament, and a yarn obtained by twisting two or more of these yarns together.

* * * * *